US006164095A

United States Patent [19]

Rock et al.

[11] Patent Number: 6,164,095

[45] Date of Patent: Dec. 26, 2000

[54] TWO FACE TERRY KNIT RAISED SURFACE FABRIC WITH FACE TO BACK COLOR DIFFERENTIATION

[75] Inventors: Moshe Rock, Andover; William K. Lie, Methuen, both of Mass.; Edward P. Dionne, South Hills, Me.

[73] Assignee: Malden Mills Industries, Inc., Lawrence, Mass.

[21] Appl. No.: 09/546,351

[22] Filed: Apr. 7, 2000

Related U.S. Application Data

[63] Continuation-in-part of application No. 09/193,208, Nov. 17, 1998, Pat. No. 6,082,147, which is a continuation-in-part of application No. 09/108,985, Jul. 1, 1998, abandoned.

[60] Provisional application No. 60/083,501, Apr. 29, 1998.

[51] Int. Cl.[7] ..... D04B 7/12; D04B 7/26

[52] U.S. Cl. ..... 66/194

[58] Field of Search ..... 66/190, 191, 137, 66/192, 193, 194, 202, 136; 442/304, 312

[56] References Cited

U.S. PATENT DOCUMENTS

| | | | |
|---|---|---|---|
| 4,881,383 | 11/1989 | Spillane et al. | 66/194 |
| 5,016,450 | 5/1991 | Pernick | 66/194 |
| 5,715,707 | 2/1998 | Makiyama et al. | 66/194 |
| 5,855,124 | 1/1999 | Donaghy et al. | 66/195 |
| 6,082,147 | 7/2000 | Rock et al. | 66/193 |

*Primary Examiner*—Danny Worrell
*Attorney, Agent, or Firm*—Gottlieb, Rackman & Reisman

[57] ABSTRACT

A raised surface fabric knit on a conventional terry knitting machine is provided. The process utilizes yarns of different color or dyeability in alternating courses; by way of example, yarn A (undyed) is used for course 1, yarn B (dyed) is used for course 2, yarn A is used for course 3, yarn B for course 4, etc. Either yarn A or yarn B has a low shrinkability, with the other yarn then having a high shrinkability.

19 Claims, 2 Drawing Sheets

FIG. 2
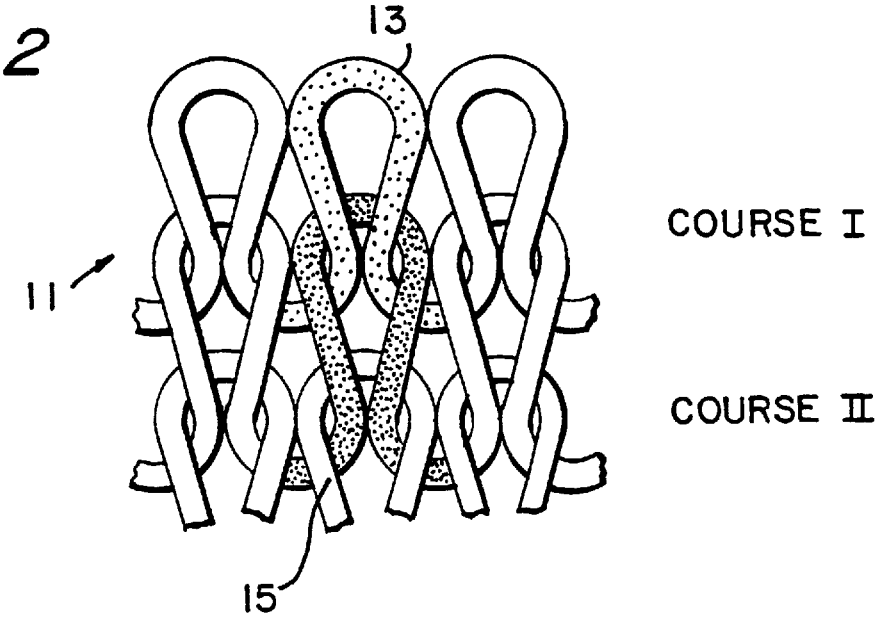
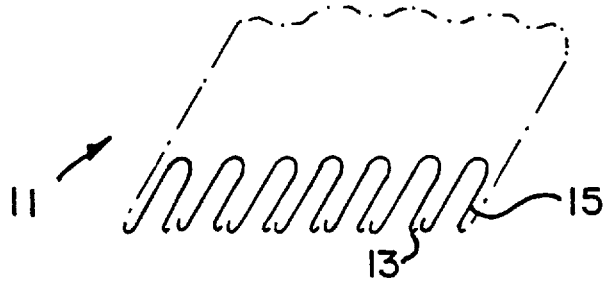
FIG. 3
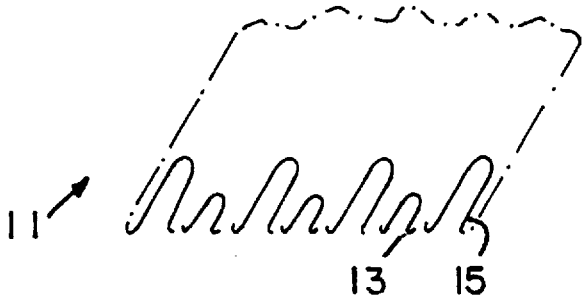
FIG. 4

TWO FACE TERRY KNIT RAISED SURFACE FABRIC WITH FACE TO BACK COLOR DIFFERENTIATION

This application claims benefit of provisional, 60/083, 501 Apr. 29, 1998

This application is a continuation-in-part (CIP) of Ser. No. 09/193,208 filed Nov. 17, 1998, U.S. Pat. No. 6,082,147 which in turn is a continuation-in-part of Ser. No. 09/108, 985 filed Jul. 1, 1998 now abandoned.

BACKGROUND OF THE INVENTION

This invention relates to a raised surface fabric which is knit on a standard terry knitting machine, and more particularly, to a terry knit raised surface fabric in which the color on the technical face is differentiated from the color on the technical back.

In general, knitted terry fabrics are a variation of a jersey knit fabric wherein two yarns are fed simultaneously into the same needle. Knitted terry is produced in weights ranging from those suitable for robes and beach wear to various types of fashion apparel.

It is also well known to incorporate two different yarns in a fabric product, each having different shrinkage properties or different dyeability properties. Reference is made to U.S. Pat. No. 3,030,691, which describes a terry fabric with a base having terry loops projecting from both faces thereof. The terry loops are formed of two or more types of yarns of varying shrinkability. They are arranged such that the loops formed of at least one of the types of yarns project from one face of the base, and loops formed of at least one of the other types of yarns project from the opposite face of the base. As a result, the opposite faces of the produced fabric are different.

It is also well known to produce a terry fabric having a high-low pile. Reference is made to U.S. Pat. No. 3,721,272, in which the terry fabric described therein has a base with terry pile yarns arranged in a pre-determined pattern of high and low pile areas on each side of the base. The high pile areas are formed from cotton terry yarns, and the low pile areas are in the form of terry loops formed of rayon terry yarns.

In all knit fabrics produced with a three-dimensional high-low effect, the pattern produced requires the use of a special knitting machine in order to achieve the desired effect.

Accordingly, it would be desirable to provide a raised surface fabric which is knit on a standard terry knitting machine with a high-low effect such that the color on the face of the fabric is different than the color on the back of the fabric after the application of heat.

SUMMARY OF THE INVENTION

Generally speaking, in accordance with the invention, a raised surface fabric, knit on a conventional terry knitting machine utilizing a reverse plaiting technique, is provided. In conventional fabrication, the same loop yarn is used in each course, and thus the fabric color is the same on both the face and the back. Here, the process utilizes loop yarns of different color, or dyeability in alternating courses; by way of example, yarn A (undyed) is used for course 1, yarn B (dyed) is used for course 2, yarn A is used for course 3, yarn B for course 4, etc.

Significantly, one of the yarns has low shrinkability, while the other has a very high shrinkability. Thus, when heat is applied to the terry knit fabric, during dyeing or during another process step, the loops of one yarn will shrink to a small fraction in size as compared to the loops of the other yarn. As a result, when the technical back of the fabric is raised, the color of one yarn will predominate. In contrast, even upon raising of the technical face, since no loops are formed on the technical face, the color produced is a blend of the colors of both yarns.

Accordingly, it is an object of the invention to provide a raised surface fabric knit on a standard terry knitting machine in which different colors are produced on the technical face and on the technical back.

Another object of the invention is to provide a raised surface fabric knit on a standard terry knitting machine utilizing different loop yarns in alternating courses.

A further object of the invention is to provide a raised surface fabric knit on a standard terry knitting machine utilizing yarns of low shrinkage and yarns of very high shrinkage.

Still other objects and advantages of the invention will in part be obvious and will in part be apparent from the following description.

The invention accordingly comprises the features of construction, combination of elements and arrangement of parts as hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which:

FIG. 2 is a front elevational view of the terry fabric construction of the invention viewed from its technical face;

FIG. 3 is a side view showing the terry loops of the inventive fabric construction prior to application of heat; and FIG. 4 is a side view of the terry loops of the fabric construction after the application of heat.

DETAILED DESCRIPTION OF THE PREFERRED EMBODIMENTS

Figure 1:
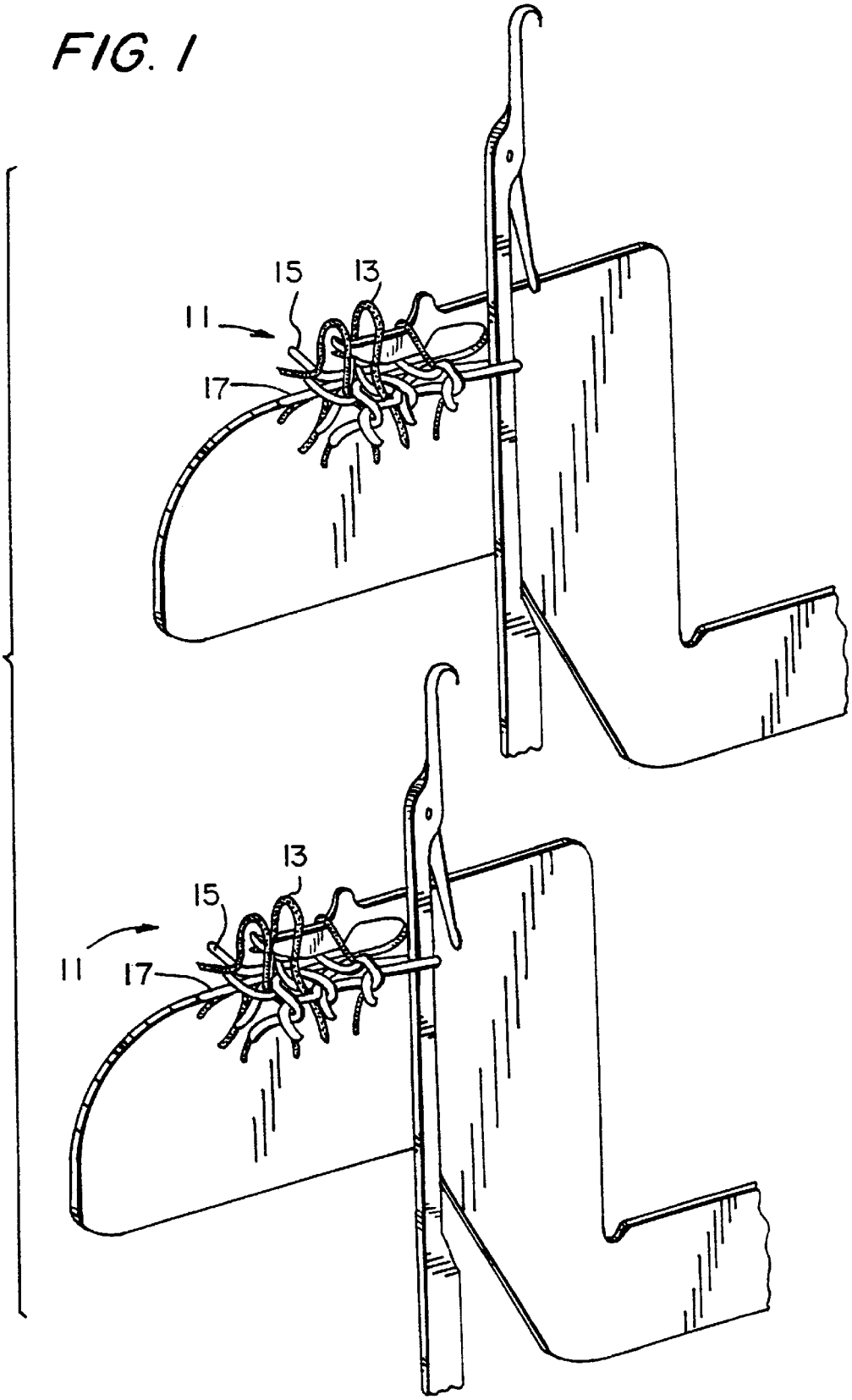
FIG. 1 is a perspective view of the inventive terry fabric construction viewed from its technical back and illustrating formation of the sinker loops.

Referring now first to FIGS. 1 and 2, a raised surface fabric made in accordance with the invention is generally indicated at 11. Fabric 11 includes alternating courses of different colored loop yarns 13 and 15 integrated with stitch or backing yarn 17. As can be appreciated, loop yarns 13 and 15 are plaited around stitch yarn 17. Fabric 11 comprises a plain stitch circular knit reverse plaited construction which is suitable for generating a two face raised surface fabric produced through napping, brushing, sanding or other types of "raising" processes.

Significantly, alternating loop yarn 13 is made from a high shrinkage material, while alternating yarn 15 is made from a low shrinkage material. High shrinkage yarn 13 may be a texturized or flat filament yarn, while low shrinkage yarn 15 may be a flat filament or spun yarn. Yarns 13 and 15 may be made from any natural material, or from rayon, acetate, polyester, acrylic or nylon. Stitch yarn 17 may be made from polyester or nylon, and may include up to 75% spandex.

Once fabric 11 is produced, heat is applied thereto, either during dyeing or as part of some other process step. The heat should be applied at a temperature of at least 2000 F. for a time sufficient to produce shrinkage of yarns 13. As a result of this application of heat, loops of yarn 13 will shrink to a small fraction in size as compared to the loops of yarn 15.

Thereafter, the technical back of fabric 11 may be raised by either a napping, brushing or sanding process such that only the color of yarn 15 will be visible. This is because of the shrinkage characteristics of yarns 13 and 15, as described above. On the other hand, raising the technical face will produce a blend of colors of yarns 13 and 15 since the technical face does not include any sinker loops. Neither yarn 13 or 15 predominates on the technical face.

Yarn 13 should have a shrinkability of between about 10 and 60 percent, whereas yarn 15 should have a shrinkability of between 0 and 30 percent. Importantly, yarn 13 should have at least 10% greater shrinkability than yarn 15.

Reference is now made to FIGS. 3 and 4. FIG. 3 shows the general structure of the technical back of fabric 11 prior to exposing the fabric to heat, while FIG. 4 shows the technical back of fabric 11 after exposing it to heat. As can be appreciated, the technical back of the fabric shown in FIG. 4 has a three-dimensional construction of high-low courses.

In an alternative form, the knit construction of the inventive fabric is modified from a knit stitch construction to a construction which includes both knit stitch and tuck stitch. As a result, there is an enhanced capability to control the face to back color differentiation since on the technical face of the inventive fabric, the tuck stitch yarns will be raised or napped substantially less than the knit stitch yarns, producing even greater color differentiation.

In particular, each of the alternating courses of loop yarn 15 (made from a low shrinkage material) is modified from a knit stitch construction to a construction which includes both knit stitch and tuck stitch (knit-tuck stitch construction), or which includes tuck stitch exclusively. Each of the alternating courses of loop yarn 13 (made of a high shrink material) is made from a knit stitch construction.

If the alternating courses of loop yarn 15 have a knit-tuck stitch construction, suitable constructions include 1×1 knit-tuck, 1×2 knit-tuck and 2×2 knit-tuck.

It will thus be seen that the objects set forth above, among those made apparent from the preceding description, are efficiently attained, and, since certain changes may be made in the invention without departing from its spirit and scope, it is the following claims which define the inventive scope.

What is claimed is:

1. A raised surface fabric knit on a standard terry knitting machine comprising a reverse plaited fabric construction having loop yarns plaited around stitch yarns, said loop yarns defined by alternating courses of two different yarns, one of said loop yarns having a low shrinkability of between about 0 and 30 percent; the other of said loop yarns having a high shrinkability of between about 10 and 60 percent, said other of said loop yarns having a shrinkability of at least 10 percent greater than said one of said loop yarns;

wherein said alternating courses of said one of said loop yarns has a construction which is at least partially tuck stitched and wherein said alternating courses of said other of said loop yarns is exclusively knit stitched;

wherein said fabric construction comprises a technical face and a technical back, the technical back of the fabric construction being raised such that only said one of said loop yarns is visible, wherein the color visible on the technical face of said fabric construction is a blend of both of said loop yarns.

2. The fabric of claim 1, wherein said one of said loop yarns is made from any one of a flat filament yarn and a spun yarn.

3. The fabric of claim 1, wherein said other of said loop yarns is made from any one of a texturized filament yarn and a flat filament yarn.

4. The fabric of claim 1, wherein said one of said loop yarns is made from a material selected from the group consisting of any natural material, acetate, rayon, polyester, acrylic and nylon.

5. The fabric of claim 1, wherein said one of said loop yarns is made from a different colored yarn than that of said other of said loop yarns.

6. The fabric of claim 1, wherein said one of said loop yarns is made from yarn of different dyeability than that of said other of said loop yarns.

7. The fabric of claim 1, wherein the stitch yarn includes up to 75% spandex.

8. The fabric of claim 1, wherein each of said alternating courses of said one of said loop yarns has a knit-tuck stitch construction.

9. The fabric of claim 1, wherein each of said alternating courses of said one of said yarns has a tuck stitch construction.

10. The fabric of claim 8, wherein said knit-tuck stitch construction is selected from the group of 1×1 knit-tuck, 1×2 knit-tuck and 2×2 knit-tuck.

11. A method for constructing a raised surface fabric knit comprising the steps of:

producing a reverse plaited fabric construction on a standard terry knitting machine having a face and a back and made from loop yarns plaited around stitch yarns in which there are alternating courses of two different loop yarns, one of said loop yarns having a low shrinkability of between about 0 and 30 percent, and the other of said loop yarns having a high shrinkability of between about 10 and 60 percent, with said other of said loop yarns having a shrinkability of at least 10 percent greater than said one of said loop yarns and with said alternating courses of said one of said loop yarns having a construction which is at least partially tuck-stitched;

applying heat to said fabric construction;

raising the loop yarns on said technical back of said fabric construction such that only said one of said loop yarns having low shrinkability is visible;

and raising the loop yarns on said technical face of said fabric construction such that a blend of said one and said other of said loop yarns is visible.

12. The method of claim 11, wherein heat is applied at a temperature of at least 200° F.

13. The method of claim 11, wherein raising of said yarns is achieved by any one of the processes of napping, brushing and sanding.

14. The method of claim 11, wherein said producing step comprises producing a combination knit and tuck stitch reverse plaited fabric construction in which each of said alternating courses of said one of said loop yarns has a knit-tuck stitch construction.

15. The method of claim 14, wherein said knit-tuck stitch construction is selected from the group consisting of 1×1 knit-tuck, 1×2 knit-tuck and 2×2 knit-tuck.

16. A raised surface fabric knit on a standard terry knitting machine comprising a reverse plaited fabric construction having loop yarns plaited around stitch yarns, the loop yarns defined by alternating courses of two types of loop yarns of different color or dyeability, one of said loop yarns having a shrinkability of at least 10% greater than that of the other of said loop yarns;

wherein said alternating courses of said one of said loop yarns is at least partially tuck stitched;

wherein said fabric construction comprises a technical face and a technical back, the technical back of the fabric construction being raised such that only the color of said other of said loop yarns is visible, wherein the color visible on the technical face of said fabric construction is a blend of the colors of both said loop yarns.

17. The fabric of claim 16, wherein said one of said loop yarns has a shrinkability of between about 10 and 60 percent.

18. The fabric of claim 16, wherein said other of said loop yarns has a shrinkability of between about 0 and 30 percent.

19. The fabric of claim 16, wherein said fabric construction is both knit stitched and tuck stitched such that each of said alternating courses of said one of said loop yarns has a knit-tuck stitch construction.

* * * * *